US005738005A

United States Patent [19]

Itakura

[11] Patent Number: 5,738,005

[45] Date of Patent: Apr. 14, 1998

[54] WORKPIECE FEEDING METHOD FOR MULTI-SLIDE PRESS

[75] Inventor: Hideo Itakura, Sagamihara, Japan

[73] Assignee: Aida Engineering Ltd., Kanagawa-ken, Japan

[21] Appl. No.: 674,595

[22] Filed: Jul. 1, 1996

[51] Int. Cl.[6] ..... B30B 15/30

[52] U.S. Cl. ..... 100/35; 72/405.11; 100/207

[58] Field of Search ..... 100/35, 193, 207–208, 100/215, 282; 72/405.01, 405.02, 405.09, 405.11, 405.12, 405.13, 452.4, 452.5

[56] References Cited

U.S. PATENT DOCUMENTS

| | | | |
|---|---|---|---|
| 3,768,667 | 10/1973 | Paumier et al. | 72/405.13 |
| 4,709,574 | 12/1987 | Horn et al. | 72/405.12 |
| 5,069,057 | 12/1991 | Lee | 100/282 |

FOREIGN PATENT DOCUMENTS

| | | | |
|---|---|---|---|
| 54-122472 | 9/1979 | Japan | 100/207 |
| 5-117705 | 5/1993 | Japan | 100/193 |

*Primary Examiner*—Stephen F. Gerrity

*Attorney, Agent, or Firm*—Wood, Phillips, VanSanten, Clark & Mortimer

[57] ABSTRACT

Disclosed is a method according to which workpieces are fed and subjected to stamping by continuously operating a press in which a plurality of slides operating with a difference in phase are arranged laterally in a straight line. A longitudinal feeding device for longitudinally feeding workpieces is provided in each slide. Each slide and the longitudinal feeding device thereof operate in synchronism with each other, so that even when the press is continuously operated, the workpieces can be fed without involving any interference between the press and the transfer device. Further, the feeding of workpieces in the lateral direction, which is executed as needed, is effected outside the machining stage, so that there is no interference regardless of the difference in phase of the slides, whereby it is possible to feed workpieces without having to intermittently operate the press.

4 Claims, 5 Drawing Sheets

WORKPIECE FEEDING METHOD FOR MULTI-SLIDE PRESS

BACKGROUND OF THE INVENTION

In a conventional workpiece feeding technique for use in a press in which a plurality of slides operating with a difference in phase are arranged laterally in a straight line, a transfer device is used to feed workpieces in lateral directions.

In the method of feeding workpieces by this transfer device, a feed bar is equipped with a plurality of fingers. When the feed bar performs a clamping operation, a plurality of workpieces are gripped simultaneously by the fingers; by an advancing operation of the feed bar, the workpieces are moved in lateral directions and, by an unclamping operation of the feed bar, the workpieces, which have been in the grip of the fingers, are released and left there. In this way, the workpieces are fed to be supplied to the machining stages of the slides for stamping. However, in this press, the stamping ranges for the slides differ in one cycle of the press, so that the proportion of the operating period of the total stamping operations is relatively large. Thus, the series of operations from the clamping to the unclamping of the feed bars cannot be performed outside the stamping range corresponding to the operating period. In view of this, to perform the series of operations while avoiding interference between the press and the transfer device, the slides of the press are temporarily stopped, that is, the press is intermittently operated to operate the transfer device to thereby feed the workpieces. However, this intermittent operation for stamping has a problem in that it entails a reduction in production. While the prior art technique has been described with reference to a two-dimensional transfer device, a similar problem is experienced with a three-dimensional transfer device in which feed bar lift/down operations are involved, or with a feeding device having an equivalent function.

SUMMARY OF THE INVENTION

It is an object of the present invention to provide a workpiece feeding method for use in a press in which a plurality of slides adapted to operate with a difference in phase are arranged laterally in a straight line, wherein the workpieces are fed to the respective machining stages of the slides and subjected to stamping by the slides without intermittently operating the press.

In the present invention, longitudinal feeding means for longitudinally feeding workpieces is provided for each slide, and, by these longitudinal feeding means, each of which operates in accordance with the operational timing of the slide, the workpieces are fed from the work feeding stages, which are on the front side, to the machining stages of the slides, and the workpieces thus fed to the machining stages are subjected to stamping, the workpieces which have undergone stamping being extracted onto work extracting stages, which are on the rear side.

When a workpiece thus extracted onto the extracting stage is to be further subjected to stamping by the adjacent slide, the workpiece is fed from the extracting stage to the workpiece supplying stage of the adjacent longitudinal feeding means by lateral feeding means for laterally feeding workpieces. As in the above-described case, the workpiece is fed longitudinally by the adjacent longitudinal feeding means. However, in this state, the front and rear sides are reversed to the above-described case. The workpiece is fed from the front to the rear side, from the rear left-hand side to the rear right-hand side, from the rear to the front side, from the front left-hand side to the front right-hand side, from the front to the rear side, etc . . . Stamping is performed on the workpiece fed to the machining stage of each slide in the middle of the longitudinal feeding line.

That is, by the longitudinal feeding means, which operates in synchronism with each slide, the workpiece is fed in the order: the supplying stage, the machining stage and the extracting stage, which are arranged along the longitudinal dimension, and stamping is performed by each slide. Since each slide and each longitudinal feeding means operate in synchronism with each other, it is possible to feed the workpiece without any interference between the press and the transfer device even when the press is continuously operated. Further, since the lateral feeding of workpieces, which is performed as needed, is performed outside the machining stage, there is no interference regardless of the difference in phase of the slides, whereby it is possible to feed workpieces without having to intermittently operate the press.

DETAILED DESCRIPTION OF THE INVENTION

The present invention will now be described with reference to embodiments, which are shown in FIGS. 1 through 5.

Figure 1B:
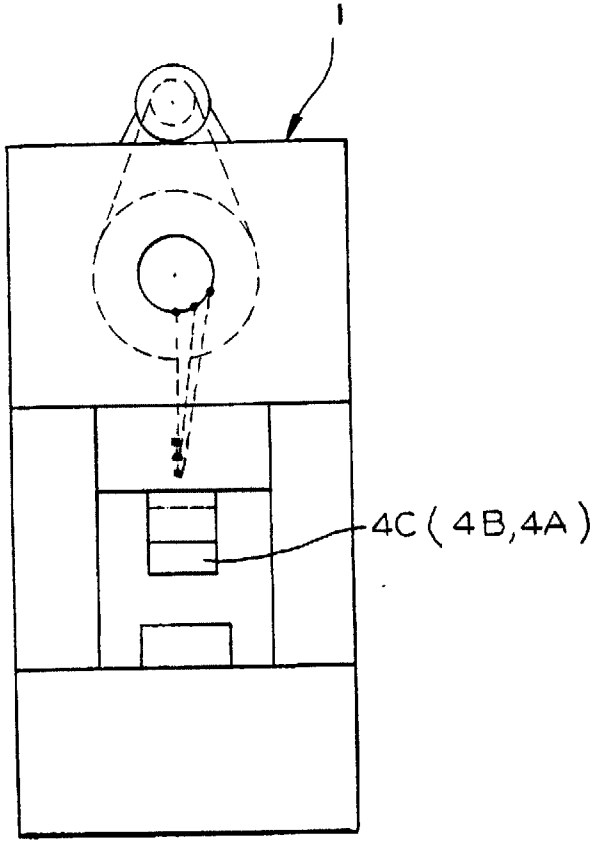
FIG. 1(B) is an end view of the press of FIG. 1(A)
Figure 1A:
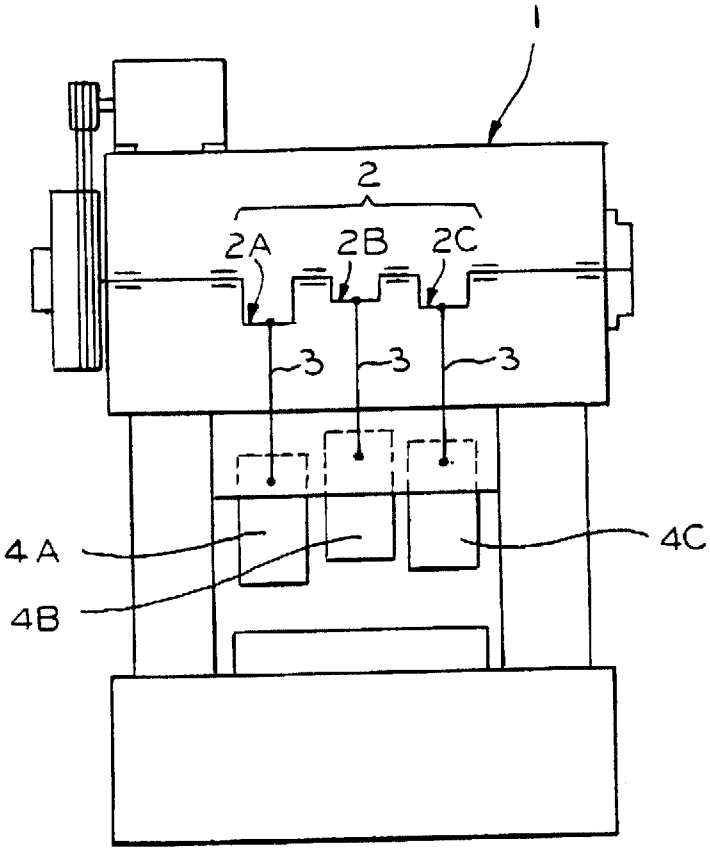
FIG. 1(A) is a side view of illustrating a press to which the present invention is applied.

FIGS. 1(A) and 1(B) show an embodiment of a press to which the present invention is applied. In this press 1, slides 4A, 4B and 4C are reciprocated by a crank shaft 2 and a plurality of connecting rods 3.

Figure 2:
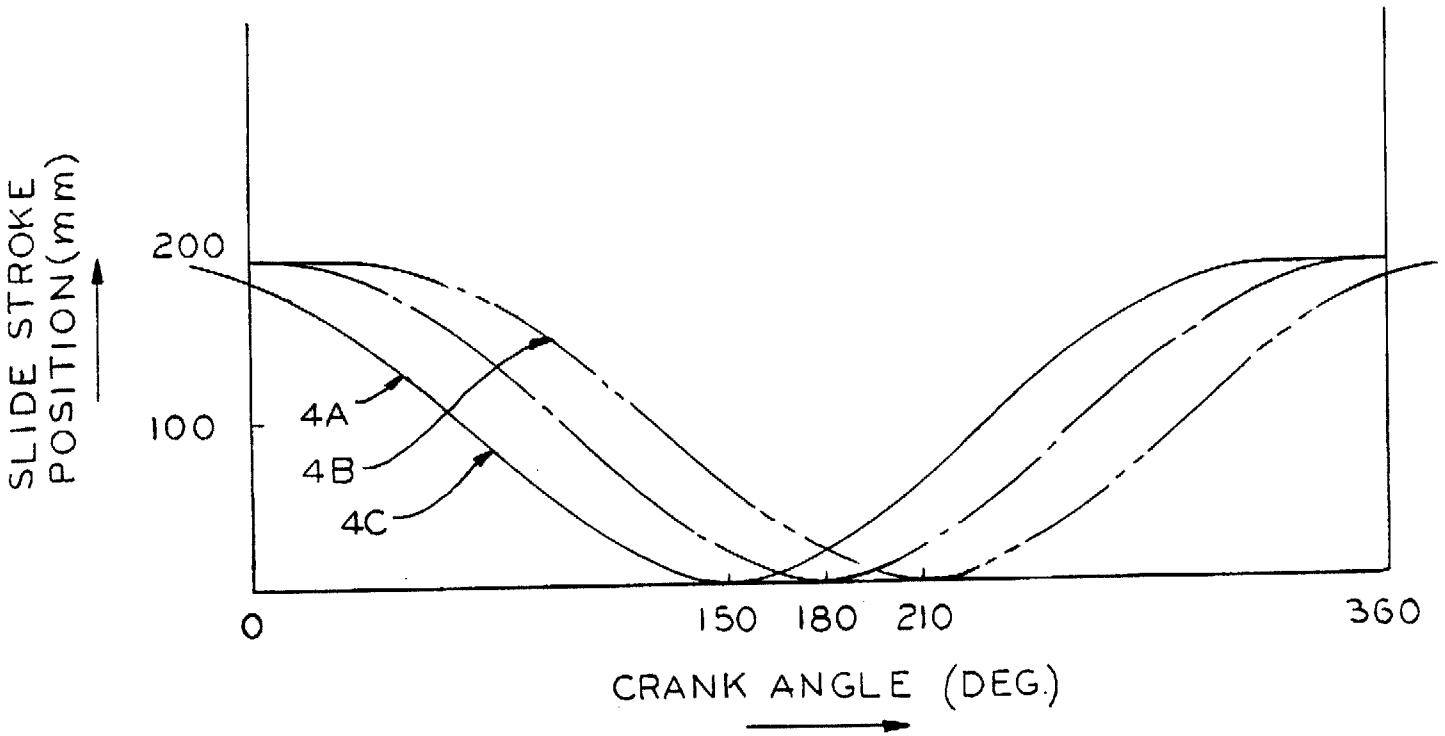
FIG. 2 is a timing chart of slides with a difference in phase to which the present invention is applied.

The crank shaft 2 has crank pins 2A, 2B and 2C which have a difference in phase, so that the slides 4A, 4B and 4C operate with the operational timing as shown in FIG. 2.

Figure 3:
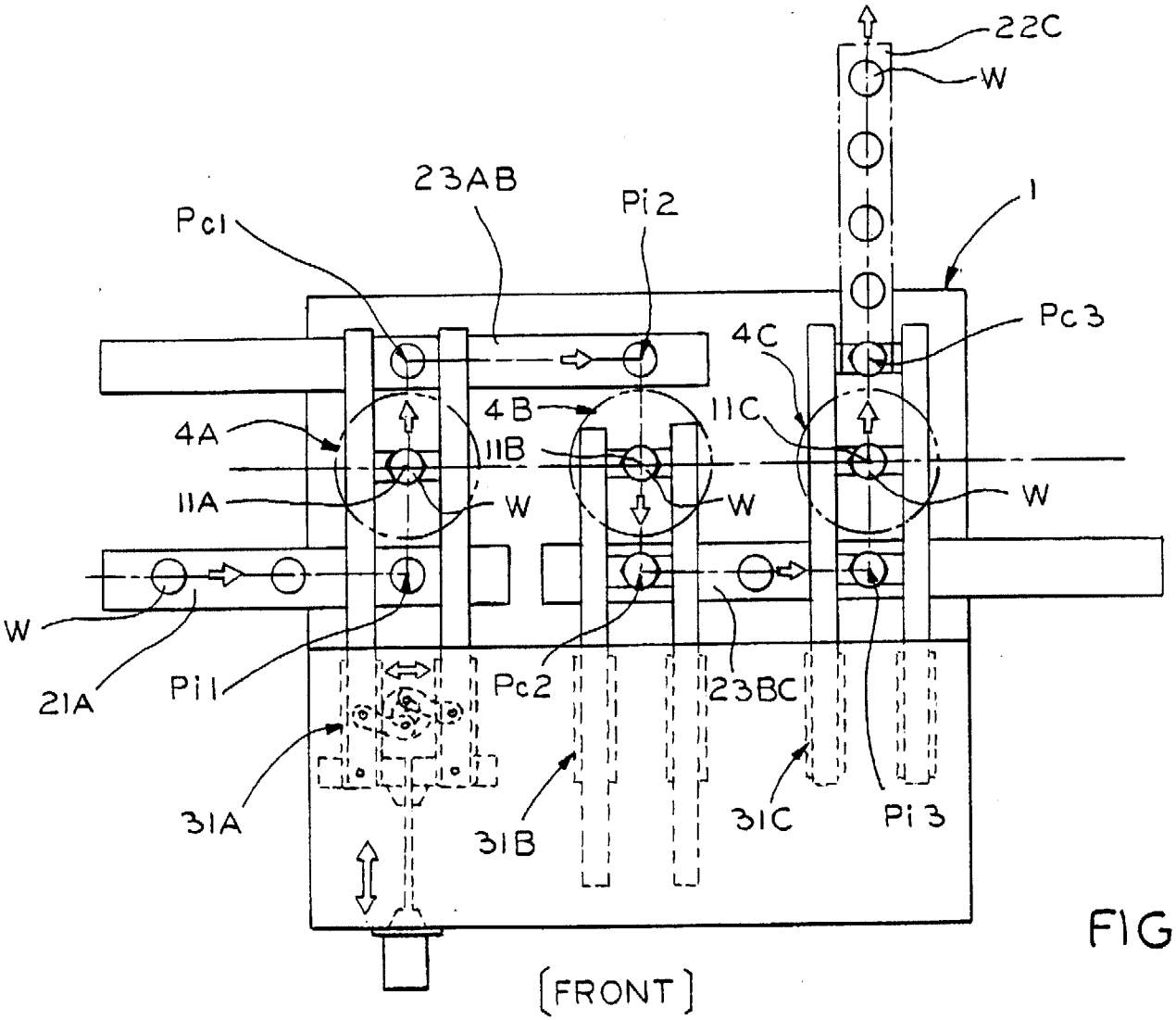
FIG. 3 is a diagram for illustrating a first embodiment of the present invention.
Figure 4:
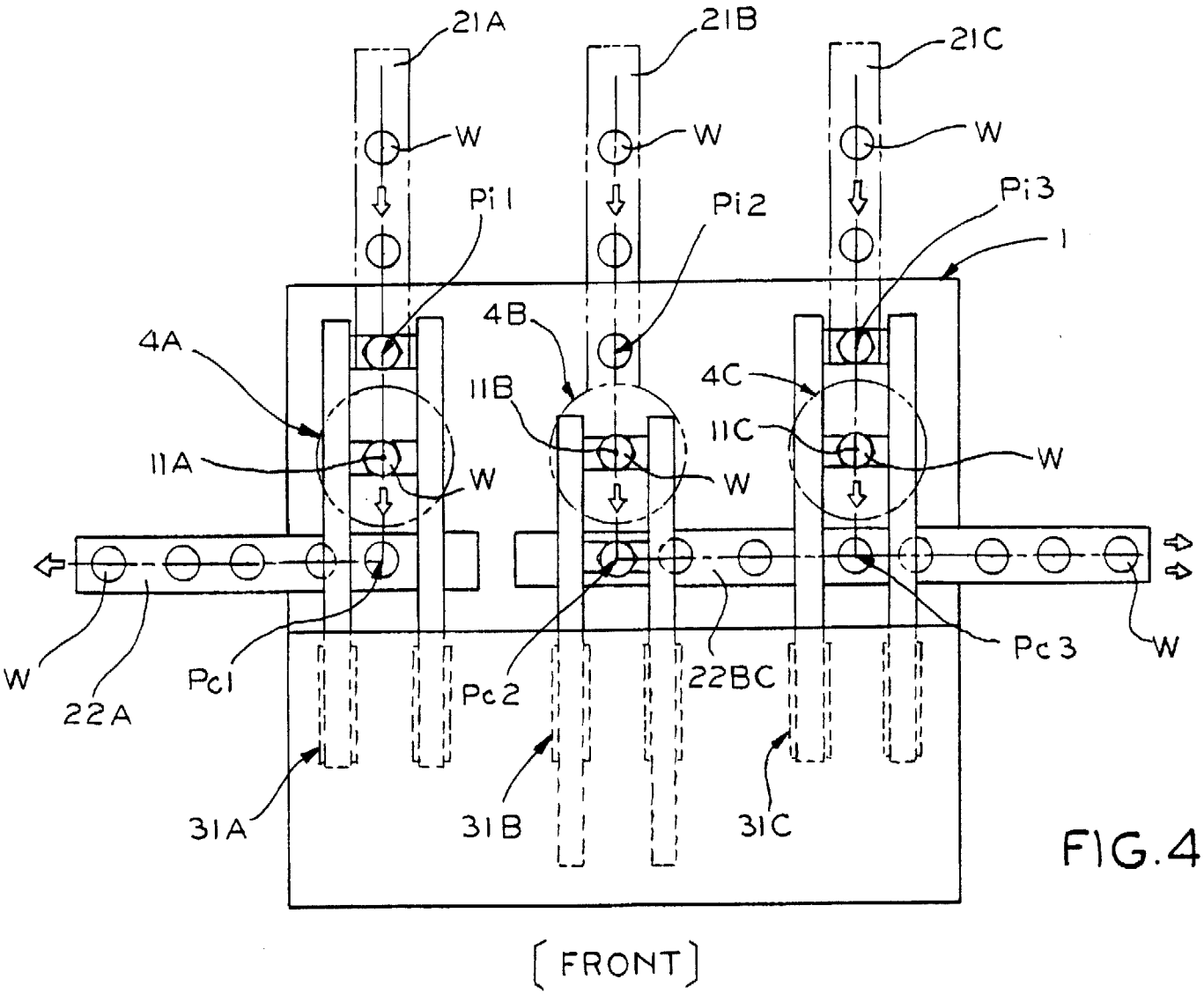
FIG. 4 is a diagram for illustrating a second embodiment of the present invention.
Figure 5:
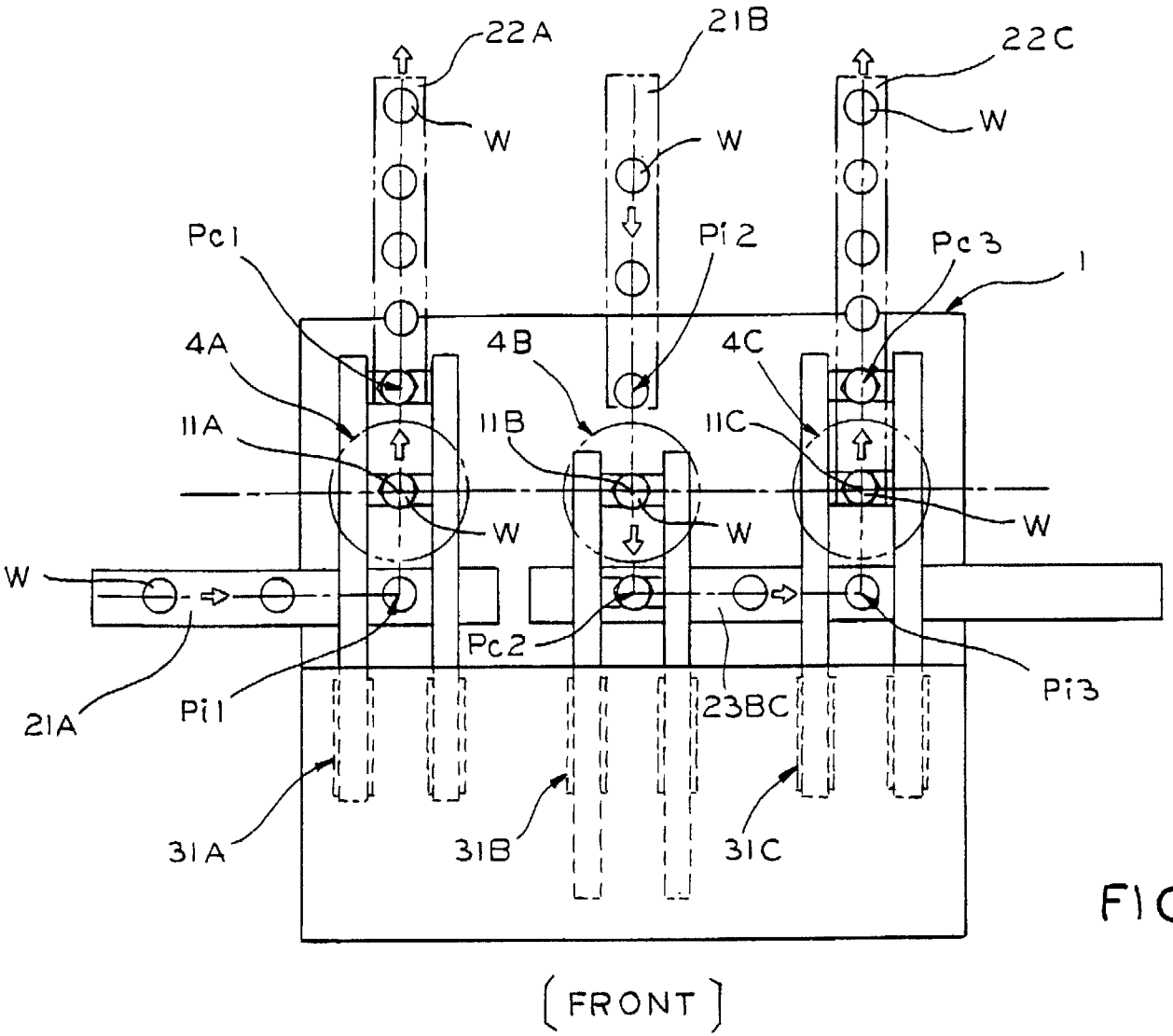
FIG. 5 is a diagram for illustrating a third embodiment of the present invention.

In FIGS. 3 through 5, longitudinal feeding means 31A, 31B and 31C for feeding workpieces W in the longitudinal direction extract workpieces W which have undergone stamping from machining stages 11A, 11B and 11C onto extracting stages Pc1, Pc2 and Pc3 and, at the same time, supply workpieces W supplied to supplying stages Pi1, Pi2 and Pi3 to the machining stages 11A, 11B and 11C. The workpieces W thus supplied are subjected to stamping at the machining stages 11A, 11B and 11C of the press 1. Each of the longitudinal feeding means 31A, 31B and 31C feed two workpieces W in the longitudinal direction at a time and is respectively provided in correspondence with each of the slides 4A, 4B and 4C and, further, is driven in synchronism with the corresponding slide. Thus, there is no interference between the longitudinal feeding means 31A, 31B and 31C and the slides 4A, 4B and 4C. The longitudinal feeding means 31A, 31B and 31C may be two-dimensional transfer devices or three-dimensional transfer devices or feeding devices having a function equal to that of theses devices. In the embodiments shown in the drawings, the transfer device is depicted schematically.

The embodiment shown in FIG. 3 will now be described.

A workpiece W which is outside the press is supplied to the supplying stage Pi1 by workpiece supplying means 21A. This workpiece W is fed from the supplying stage Pi1 to the machining stage 11A by the longitudinal feeding means 31A, which is operated in synchronism with the slide 4A and, in the machining stage 11A, it is subjected to stamping. The workpiece W which has thus undergone stamping is fed to the extracting stage Pc1 by the next cycle of the press.

This workpiece W is fed to the supplying stage Pi2 by lateral feeding means 23AB. Next, this workpiece is fed from the supplying stage Pi2 to the machining stage 11B and then to the extracting stage Pc2 by the lateral feeding means 31B as in the above-described case.

The workpiece W fed to the extracting stage Pc2 is fed to the supplying stage Pi3 by the lateral feeding means 23BC. Next, this workpiece W similarly is fed from the supplying stage Pi3 to the machining stage 11C and then to the extracting stage Pc3 by the longitudinal feeding means 31C.

The workpiece W at this extracting stage Pc3 is fed to the exterior of the press by work discharging means 22C.

Due to this arrangement, one workpiece W which has undergone stamping through three processes is obtained by one cycle of the three slides having a difference in phase.

Another embodiment, which is shown in FIG. 4, will now be described.

A workpiece W which is outside the press is supplied to the supplying stage Pi1 by the workpiece supplying means 21A. This workpiece W is fed from the supplying stage Pi1 to the machining stage 11A by the longitudinal feeding means 31A, which operates in synchronism with the slide 4A. In the machining stage 11A, the workpiece is subjected to stamping. The workpiece W which has thus undergone stamping is fed to the extracting stage Pc1 by the next cycle of the press.

The work W at this extracting stage Pc1 is fed to the exterior of the press by the workpiece discharging means 22A.

Another workpiece W which is outside the press is supplied to the supplying stage Pi2 by the workpiece supplying means 21B. This workpiece W is similarly fed from the supplying stage Pi2 to the machining stage 11B and then to the extracting stage Pc2 by the longitudinal feeding means 31B.

The workpiece W at this extracting stage Pc2 is fed to the exterior of the press by the workpiece discharging means 22BC.

Still another workpiece W which is outside the press is supplied to the supplying stage Pi3 by the work supplying means 21C. This workpiece W is similarly fed by the supplying stage Pi3 to the machining stage 11C and then to the extracting stage Pc 3 by the longitudinal feeding means 31C.

This workpiece W at the extracting stage Pc3 is fed to the exterior of the press by the workpiece discharging means 22BC.

Due to this arrangement, three workpieces W which have undergone stamping through a single process are obtained by one cycle of a press having three slides having a difference in phase.

Another embodiment, which is shown in FIG. 5, will now be described.

A workpiece W which is outside the press is supplied to the supplying stage Pi1 by the workpiece supplying means 21A. This workpiece W is fed from the supplying stage Pi1 to the machining stage 11A by the longitudinal feeding means 31A, which operates in synchronism with the slide 4A. In the machining stage 11A, the workpiece W is subjected to stamping, and the workpiece W, which has thus undergone stamping, is fed to the extracting stage Pc1 by the next cycle of the press. The workpiece W at this extracting stage Pc1 is fed to the exterior of the press by the workpiece discharging means 22A.

Another workpiece W which is outside the press is supplied to the supplying stage Pi2 by the workpiece supplying means 21B. This workpiece W is similarly fed from the supply stage Pi2 to the machining stage 11B and then to the extracting stage Pc2 by the longitudinal feeding means 31B.

The workpiece W fed to the extracting stage Pc2 is fed to the supplying stage Pi3 by the lateral feeding means 23BC.

This workpiece W is similarly fed from the supplying stage Pi3 to the machining stage 11C and then to the extracting stage Pc3 by the longitudinal feeding means 31C.

This workpiece W thus fed to the extracting stage Pc3 is fed to the exterior of the press by the workpiece discharging means 22C.

Due to this arrangement, a workpiece W which has undergone stamping through one process and a workpiece W which has undergone stamping through processes are simultaneously obtained by one cycle of a press having three slides with a difference in phase.

While the above embodiments have been described with reference to a press in which three slides are provided, it is obvious that, when a plurality of slides are provided, adoption of this workpiece feeding method makes it possible to feed workpieces and subject them to stamping, with the press being continuously operated.

Further, it is possible to reverse the workpiece feeding directions of the workpiece feeding means 21A and 21C to use them in place of the workpiece discharging means 22A and 22C, and it is also possible to vary the workpiece feeding amount of the lateral workpiece feeding means 23BC to use it in place of the workpiece discharging means 22BC.

What is claimed is:

1. A workpiece feeding method for a multi-slide press of the type in which a plurality of slides operating with a difference in phase are arranged in a straight line in the lateral direction of the press and in which workpieces are fed to machining stages provided respectively in the slides and extracted after undergoing stamping at the slides, wherein each said slide includes a longitudinal feeding means which supplies a workpiece from a workpiece supplying stage provided in front of or at the back of the press to the machining stage and, after the stamping of the workpiece, extracts it onto a workpiece extracting stage provided at the back of or in front of the press, respectively, and wherein a workpiece is fed for stamping in each slide.

2. A workpiece feeding method for a multi-slide press according to claim 1, wherein a workpiece is supplied from the outside of the press to the first workpiece supplying stage laterally by a workpiece supplying means and fed to the workpiece extracting stage by a longitudinal feeding means, the workpiece thus fed to the extracting stage being fed to the workpiece supplying stage of the adjacent longitudinal feeding means by the lateral feeding means and then fed to the workpiece extracting stage by the adjacent longitudinal feeding means, the above processes being repeated to feed workpieces for stamping.

3. A workpiece feeding method for a multi-slide press according to claim 2, wherein workpieces are fed from the outside of the press longitudinally to the respective workpiece supplying stages of the longitudinal feeding means, the workpiece being then fed to the workpiece extracting stages by the longitudinal feeding means, the workpieces thus fed to the extracting stages being extracted to the exterior of the press by lateral extracting means for feeding workpieces laterally, whereby different workpieces are subjected to stamping in different slides.

4. A workpiece feeding method for a multi-slide press according to claim 1, wherein workpieces are fed from the outside of the press longitudinally to the respective workpiece supplying stages of the longitudinal feeding means, the workpiece being then fed to the workpiece extracting stages by the longitudinal feeding means, the workpieces thus fed to the extracting stages being extracted to the exterior of the press by lateral extracting means for feeding workpieces laterally, whereby different workpieces are subjected to stamping in different slides.

* * * * *